US010039430B2

(12) United States Patent
Hyun

(10) Patent No.: US 10,039,430 B2
(45) Date of Patent: Aug. 7, 2018

(54) VACUUM CLEANER

(71) Applicant: LG ELECTRONICS INC., Seoul (KR)

(72) Inventor: Kietak Hyun, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 868 days.

(21) Appl. No.: 13/940,584

(22) Filed: Jul. 12, 2013

(65) Prior Publication Data

US 2014/0013536 A1 Jan. 16, 2014

(30) Foreign Application Priority Data

Jul. 12, 2012 (KR) ..... 10-2012-0075930

(51) Int. Cl.
*A47L 9/10* (2006.01)
*A47L 9/22* (2006.01)

(52) U.S. Cl.
CPC ..... *A47L 9/10* (2013.01); *A47L 9/106* (2013.01); *A47L 9/22* (2013.01)

(58) Field of Classification Search
None
See application file for complete search history.

(56) References Cited

U.S. PATENT DOCUMENTS 1,927,226 A * 9/1933 Woods ..... A47L 11/161 15/29
2,600,233 A * 6/1952 Finnell ..... A47L 11/1625 15/50.1
3,033,711 A * 5/1962 Harding ..... B24C 3/32 134/7
3,316,579 A * 5/1967 Smith ..... A47L 11/30 15/320
4,628,644 A * 12/1986 Somers ..... B24C 5/02 222/484
7,951,230 B2 * 5/2011 Sepke ..... A47L 7/04 15/347
2005/0081321 A1 * 4/2005 Milligan ..... A47L 5/24 15/344
2008/0230446 A1 * 9/2008 Bertram ..... A47L 9/102 209/10
2012/0219443 A1 * 8/2012 Neel ..... F04C 23/005 418/1

* cited by examiner

*Primary Examiner* — Christopher M Koehler
*Assistant Examiner* — Brian Keller
(74) *Attorney, Agent, or Firm* — Ked & Associates LLP

(57) ABSTRACT

A vacuum cleaner is provided. The vacuum cleaner may include a suction nozzle coupled to a body and adapted to move along a surface to be cleaned, a guide pipe to guide foreign substances including dust suctioned through in the suction nozzle, a separation member to separate the foreign substances including dust guided along the guide pipe from air according to a principle of cyclonic separation, a collection container to accommodate the foreign substances including dust separated in the separation member, a binder supply device connected to the guide pipe to supply a binder to the separation member, the binder being in a shape of solid granules, and a heat supply device to supply heat to the collection container. The binder may bind with the dust due to heat supplied from the heat supply device. Thus, a larger amount of foreign substances including dust may be accumulated in the collection container, and therefore, the collection container may be effectively used.

12 Claims, 12 Drawing Sheets

VACUUM CLEANER

CROSS-REFERENCE TO RELATED APPLICATION(S)

This application claims priority to Korean Patent Application No. 10-2012- 0075930 filed in Korea on Jul. 12, 2012, which is hereby incorporated by reference as if fully set forth herein.

BACKGROUND

1. Field

A vacuum cleaner is disclosed herein, and more particularly, a vacuum cleaner which is capable of accumulating a large amount of foreign substances in a dust collecting basket.

2. Background

Vacuum cleaners are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
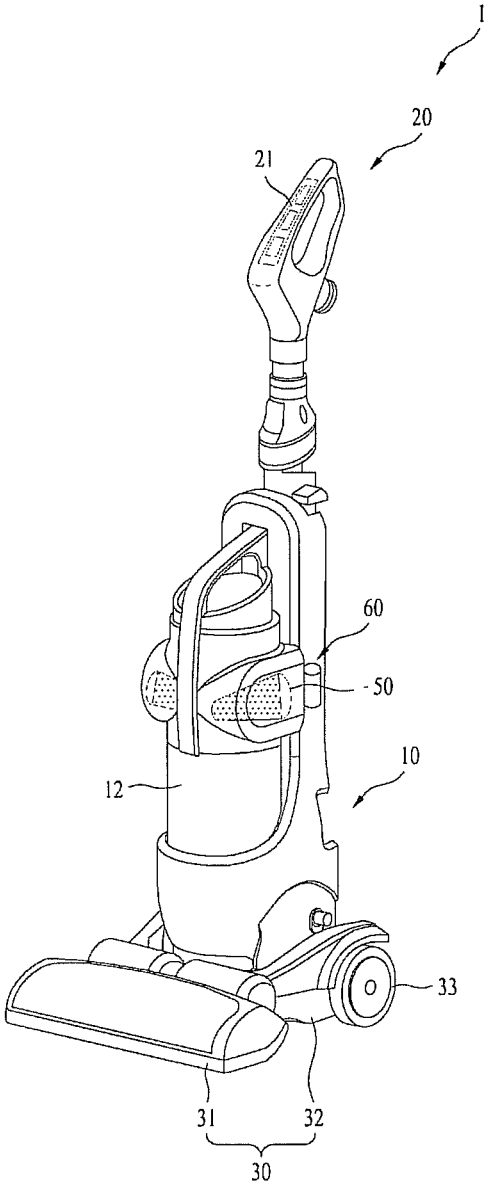
FIG. 1 is a schematic front perspective view of a vacuum cleaner according to an embodiment.

Reference will now be made in detail to the embodiments, examples of which are illustrated in the accompanying drawings. Wherever possible, the same or like reference numbers will be used throughout the drawings to refer to the same or like parts, and repetitive disclosure omitted.

Sizes and shapes of components shown in the drawings may be exaggerated for clear and easy description. In addition, terms specifically defined in consideration of the configuration and operation may be differently defined according to intention of a user or operator or practices. These terms should be defined based on the entire context of this specification.

In general, a vacuum cleaner is an apparatus that suctions in air, dust, and foreign substances using a motor mounted in a body thereof, and then filters the dust and foreign substances in the body. Vacuum cleaners performing the above functions may be broadly classified into up-right type cleaners having a suction nozzle, functioning as a suction inlet, integrated with the body, and canister type cleaners having the suction nozzle connected to the body via a connection pipe.

The up-right type vacuum cleaner may include a vacuum cleaner body provided therein with a motor to generate a suction force, a suction nozzle to suction dust and foreign substances on a surface to be cleaned into the body of the vacuum cleaner using the suction force generated by the motor, and a knob or handle arranged on an upper portion of the body of the vacuum cleaner to allow the suction nozzle to be grasped by a user and moved along a surface. That is, when the motor is driven by electric power applied to the body, a suction force may be generated. Air containing dust and foreign substances on a surface may, in turn, be suctioned into the suction nozzle by the suction force. Then, the suctioned air containing the dust and foreign substances may be introduced into the body of the vacuum cleaner, and the dust and foreign substances separated from the air in a dust collection basket or container mounted in the body, according to a principle of cyclonic separation.

In the case of such a vacuum cleaner as described above, an inner volume of the dust collection container may be limited. Accordingly, when a volume of dust and foreign substances accumulated in the dust collection container exceeds a certain volume, it needs to be discharged. Frequent discharges may inconvenience a user. In addition, when the dust and foreign substances are discharged from the dust collection container, they may be blown to outside, thereby dirtying surroundings.

FIG. 1 is a schematic front perspective view of a vacuum cleaner according to an embodiment. Hereinafter, description will be given with reference to FIG. 1.

In the illustrated embodiments, an up-right type vacuum cleaner is specifically shown. However, embodiments are applicable not only to an up-right type vacuum cleaner, but also to a canister type or other type vacuum cleaner.

The vacuum cleaner 1 shown in FIG. 1 may include a body 10 having a dust collection container 12 mounted thereto to collect dust and foreign substances present on a surface to be cleaned, a suction nozzle 30 arranged at a lower side of the body 10 to suction in the dust and foreign substances scattered on the surface together with air, and a handle 20 arranged at an upper side of the body 10 configured to be grasped by a user when the user performs cleaning.

The body 10 may be seated on and pivotably coupled to an upper portion of the suction nozzle 30 to allow variation in orientation angle of the body 10 with respect to the surface to be cleaned. During a cleaning operation, the user may support the body 10 such that the body 10 is maintained at an angle with respect to the surface to be cleaned.

In addition, the dust collection container 12 may be detachably coupled to a front surface of the body 10. The dust collection container 12 may be provided with a dust separation member 50 to separate dust and foreign substances contained in the air suctioned into the body 10 according to the principle of cyclonic separation.

That is, the air suctioned into the body 10 through the suction nozzle 30 may be introduced into the dust collection container 12. The dust and foreign substances contained in the air introduced into the dust collection container 12 may be filtered by the dust separation member 50 and collected in the dust collection container 12. The air, from which dust and foreign substances have been removed, may be discharged from the body 10. As the dust collection container 12 is detachably coupled to the body 10, the user may dump the dust and foreign substances collected in the dust collection container 12 by removing the dust collection container 12 from the body 10.

While the dust collection container 12 is illustrated in FIG. 1 as being formed in a cylindrical shape, embodiments are not so limited. For example, the dust collection container 12 may be formed in a polyprism, such as a square column.

The suction nozzle 30 may include a nozzle 31 to suction in the dust and foreign substances scattered on the surface to be cleaned together with air, and a seat 32 that allows the body 10 to be seated therein or thereon. When the user performs cleaning, the nozzle 31 may be moved back and forth, and left and right to suction in the dust and foreign substances present on the surface to be cleaned.

A pair of wheels 33 may be rotatably arranged at both sides of the seat 32, which may be connected to the nozzle 31 and allow the body 10 to be seated therein. That is, when the nozzle 31 moves with respect to the surface, the seat 32 connected to the nozzle 31 may also move. The pair of wheels 33 may rotate to smoothly move the suction nozzle 30 along the surface.

The handle 20 may be arranged on or at the upper side of the body 10. Accordingly, in cleaning, the user may grasp the handle 20 to support the body 10 such that the body 10 remains at a predetermined angle with respect to the surface to be cleaned.

In addition, a manipulation or control panel 21 may be provided at a front of the handle 20. By pushing buttons arranged on the manipulation panel 21, the user may control operations of the vacuum cleaner 1. For example, a suction force of the suction nozzle 30 and a cleaning time may be adjustable according to a state of the surface to be cleaned. Thereby, user convenience may be improved.

A binder supply device 60 may be provided at one side of the body 10 to supply a binder to foreign substances, such as dust. The binder, which may be a material that melts at a low temperature, such as paraffin wax/beeswax, may be in the form of small solid granules. The binder may have a diameter of about 100 μm. The binder may melt at about 50° C., and may return to solid phase when the temperature decreases.

The binder supply device 60 may be disposed in a channel through which foreign substances, such as dust, suctioned into the suction nozzle 30 may be introduced into the body 10, to allow the foreign substances and the binder to be mixed together. Further, the binder supply device 60 may be positioned to be exposed to outside of the body 10, as shown in FIG. 1. In the case that the binder supply device 60 is exposed to the outside, the user may easily replace the binder supply device 60.

Alternatively, the binder supply device 60 may be accommodated in the body 10. The binder supply device 60, which only needs to be disposed in the channel through which dust suctioned by the suction nozzle 30 moves, may have various shapes.

Figure 2:
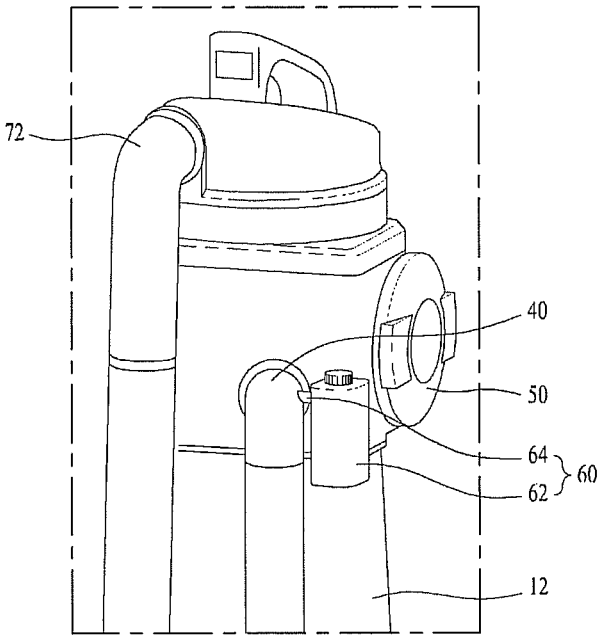
FIG. 2 is a schematic perspective view of a binder supply device of the vacuum cleaner of FIG. 1.

FIG. 2 is a schematic perspective view of a binder supply device of FIG. 1. Hereinafter, description will be given with reference to FIG. 2.

FIG. 2 shows a guide pipe 40, which may guide dust suctioned into the suction nozzle 30, the dust separation member 50, which may separate the dust flowing in through the guide pipe 40 from the air according the principle of cyclonic separation, the dust collection container 12, which may accommodate the dust separated by the dust separation member 50, and the binder supply device 60, which may be connected to the guide pipe 40 to supply the binder in the form of solid granules to the guide pipe 40. As the binder supply device 60 may be installed to communicate with the guide pipe 40, the binder may be supplied to the dust having before the dust moved through the guide pipe 40 enters the dust separation member 50. That is, the binder may be supplied to the dust before the dust is introduced into the dust separation member 50.

More particularly, the binder may be mixed with the dust in the dust separation member 50. That is, the dust and the binder may be moved together through the guide pipe 40, and be churned in the dust separation member 50 to be uniformly mixed.

The binder supply device 60 may include a binder case 62 to accommodate the binder, and a communication pipe 64 that allows the binder case 62 and the guide pipe 40 to communicate with each other therethrough. The communication pipe 64 may be formed in the shape of a pipe having a hollow space therein to provide a path along which the binder accommodated in the binder case 62 may move to the guide pipe 40.

The foreign substances, such as dust, suctioned into the dust separation member 50 and the air may be discharged to a guide duct 72, and the foreign substances including dust may be separated from the air and placed in the dust collection container 12. At this time, separation occurs according to the principle of cyclonic separation. As it is well known, a detailed description of this principle has been omitted.

The binder may be guided from the dust separation member 50 to the dust collection container 12 along with the foreign substances including dust. As the binder is formed of small grains having a diameter of about 100 μm and a small mass, the binder may be easily moved from the dust separation member 50 to the dust collection container 12.

In the dust separation member 50 where the foreign substances including dust may be separated from the air according to the principle of cyclonic separation, a rotational flow of air may be produced. Accordingly, the foreign substances including dust and the binder may be uniformly mixed in the dust separation member 50 while rotating together. In other words, even in a case that the binder is not uniformly supplied to the guide pipe 40 through the communication pipe 64, the binder may be uniformly distributed into the foreign substances including dust as the binder and the foreign substances are rotated in the dust separation member 50.

Figure 3A:
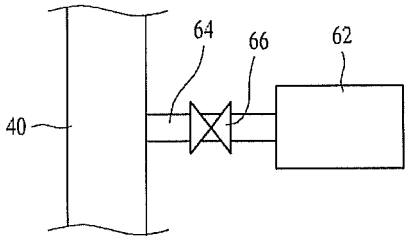
FIGS. 3A-3B are cross-sectional views illustrating various shapes of a binder supply device according to embodiments.
Figure 3B:
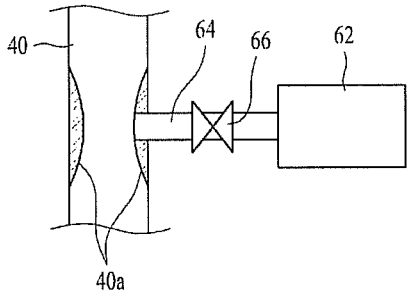

FIGS. 3A-3B are a cross-sectional views illustrating various shapes of a binder supply device according to embodiments. Hereinafter, description will be given with reference to FIGS. 3A-3B.

Referring to FIG. 3A, the guide pipe 40 and the binder case, 62 may be connected to each other by communication pipe 64. An opening and closing valve 66 may be installed in the communication pipe 64 to open and close the communication pipe 64.

That is, when the opening and closing valve 66 opens the communication pipe 64, the binder may be supplied from the binder case 62 to the guide pipe 40 via the communication pipe 64. On the other hand, when the opening and closing valve 66 closes the communication pipe 64, the binder cannot be supplied from the binder case 62 to the guide pipe 40 via the communication pipe 64.

The opening and closing valve 66 may be operated by a user, for example, by manipulation of the manipulation panel 21 shown in FIG. 1. For example, the user may control the opening and closing valve 66 to open or close the communication pipe 164 using buttons installed on the manipulation panel 21.

Alternatively, the opening and closing valve 66 may open the communication pipe 64 when the vacuum cleaner operates, and may close the communication pipe 64 when the vacuum cleaner does not operate. In this case, the opening and closing valve 66 may operate according to whether the vacuum cleaner operates.

Referring to FIG. 3B, with this embodiment, the guide pipe 40 and the binder case 62 may be connected to each other by the communication pipe 64. An opening and closing valve 66 may be installed in the communication pipe 64 to open and close the communication pipe 64. Compared to FIG. 3A, at least one protruding segment 40*a* may be provided at a portion of the guide pipe 40 where the communication pipe 64 communicates with or is installed at or to the guide pipe 40. The at least one protruding segment 40*a* may protrude inside of or within the guide pipe 40 to have a predetermined inclination such that an inner diameter of the guide pipe 40 decreases and then increases. With such a protruding segment 40*a*, a portion where the guide pipe 40 is connected to the communication pipe 64 may form an orifice.

That is, a velocity of flow of air in the guide pipe 40 may increase at the portion where the protruding segment 40*a* is formed, and therefore pressure at that portion may decrease. Thereby, the binder accommodated in the binder case 62 may move to the guide pipe 40 through the communication pipe 64.

In another embodiment different from that shown in FIGS. 3A-3B, the guide pipe 40 and the binder case 62 may be connected to each other without a separate opening and closing valve installed in the communication pipe 64, as the binder accommodated in the binder case 62 may be caused to substantially move in response to a change in pressure which occurs when air moves in the guide pipe 40.

Alternatively, the binder case 62 may be connected to various positions, such that the binder is supplied to the dust before the dust enters the guide pipe 40, that is, the dust separation member 50.

Figure 4:
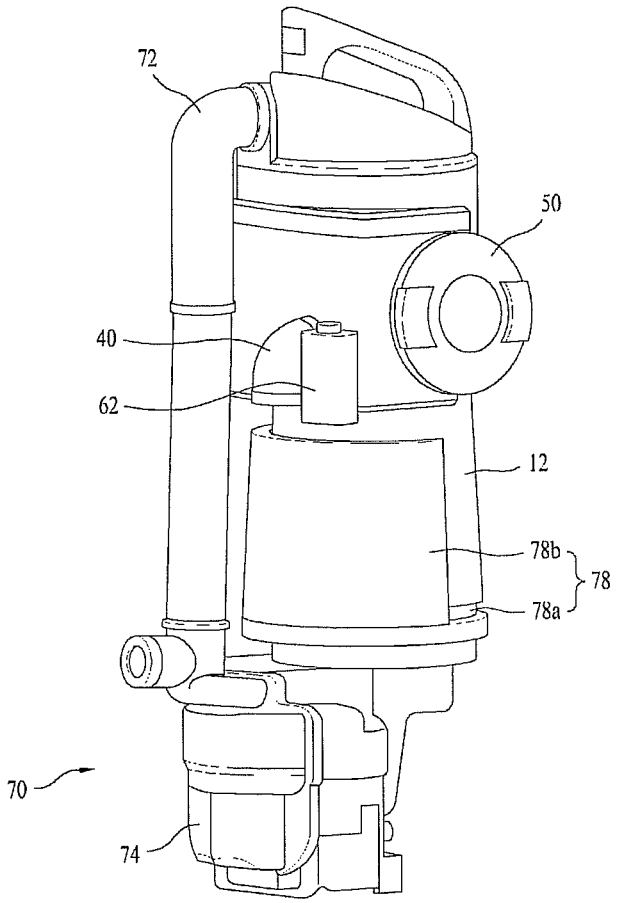
FIG. 4 is a schematic perspective view of a heat supply device according to an embodiment.

FIG. 4 is a schematic perspective view of a heat supply device according to an embodiment. Hereinafter, description will be given with reference to FIG. 4.

As shown in FIG. 4, this embodiment may include a heat supply device 70 to supply heat to the dust collection container 12. The binder may be transformed from solid to liquid by heat applied by the heat supply device 70. The liquid binder may bind with the dust to turn the dust into a larger mass.

That is, the heat supply device 70 may provide heat to the binder, which melts at about 50° C., to create an environment allowing the binder to melt in the dust collection container 12. The dust collection container 12 may be heated by the heat supplied from the heat supply device 70. As the binder melts in the dust collection container 12, it may bind with dust, increasing the mass of bonded dust particles.

The heat supply device 70 may include motor 74 to generate flow in the dust separation member 50, the guide duct 72 to guide the air separated in the dust separation member 50 such that the air exchanges heat with the motor 74, and a discharge port 78 to guide the air such that the air is discharged from the guide duct 72 toward the dust collection container 12. The discharge port 78 may be arranged adjacent to the dust collection container 12 to allow hot air heated by heat from the motor 74 in the guide duct 72 to be injected into the dust collection container 12.

The temperature of the motor 74 may generally increase up to about 100° C. Accordingly, when the air is moved to the motor 74 via the guide duct 72, it may be heated.

Figure 5:
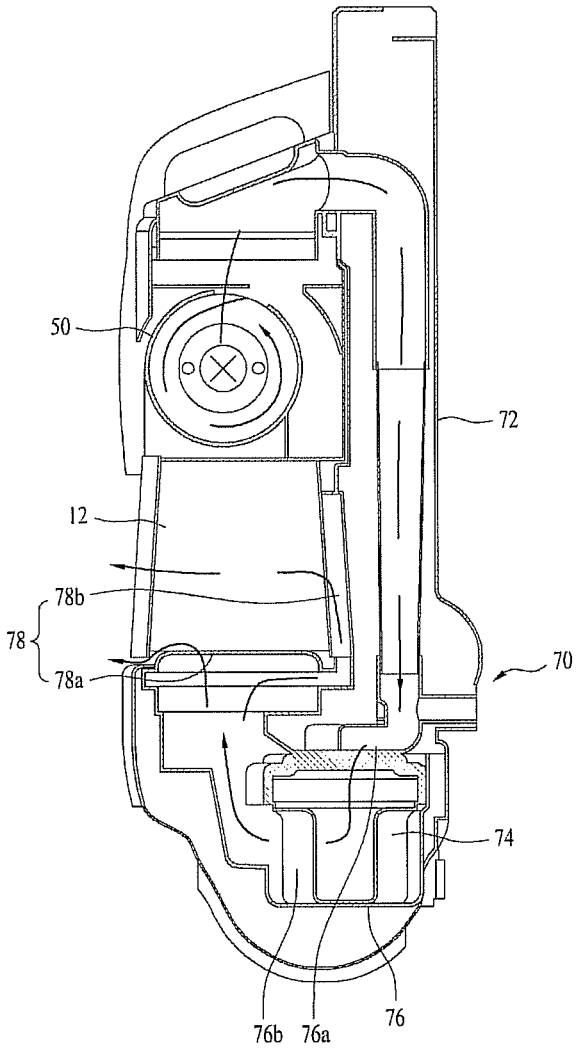
FIG. 5 is a cross-sectional view of the heat supply device of FIG. 4.
Figure 6:
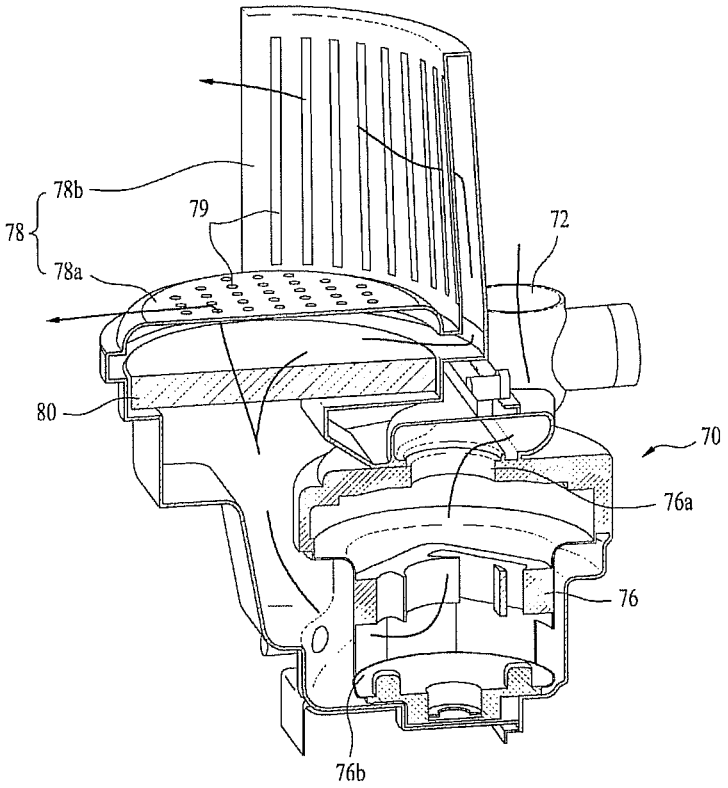
FIG. 6 is a cross-sectional view of the heat supply device of FIG. 4.

FIG. 5 is a cross-sectional view of the heat supply device of FIG. 4. FIG. 6 is a cross-sectional view of the heat supply device of FIG. 4. The motor is omitted from FIG. 6. Hereinafter, description will be given with reference to FIGS. 5 and 6.

Referring to FIGS. 5-6, the body 10 may be provided with a chamber 76 to accommodate the motor 74. The guide duct 72 may be arranged to penetrate the chamber 76. That is, as air moving through the guide duct 72 passes through the chamber 76, the air may substantially easily exchange heat with the motor 74, and thus, the temperature thereof may increase.

The discharge port 78 may include a side discharge port 78*b* provided at a side surface of the dust collection container 12, and a lower surface discharge port 78*a* provided at a lower surface of the dust collection container 12. The side discharge port 78*b* may be formed along a side surface of the dust collection container 12 which contacts the body 10, thereby causing the air from the guide duct 72 to be injected toward or along the side surface of the dust collection container 12. The side discharge port 78*b* may be formed to extend by a predetermined angle along an outer circumferential surface of the dust collection container 12. The lower surface discharge port 78*a* may be formed on or at a lower surface of the dust collection container 12 which contacts the body 10, thereby causing the air to be injected toward the lower surface of the dust collection container 12.

As the foreign substances including dust and the binder accumulated in the dust collection container 12 have predetermined masses, they are likelier to be distributed at the lower side of the dust collection container 12 than at the upper side thereof. Accordingly, when the dust collection container 12 is heated by hot air injected from the lower surface discharge port 78*a*, the binder accommodated in the dust collection container 12 may more easily absorb heat and thus more easily bind with the foreign substances including dust.

The chamber 76 may be provided with an inlet 76*a* that allows the air to be introduced from the guide duct 72 into the chamber 76 therethrough, and an outlet 76*b* that allows the air to be discharged from the chamber 76 to the guide duct 72 therethrough. That is, the air may flow into the chamber 76 through the inlet 76*a* and exchange heat with the motor 74. The air may then be discharged from the chamber 76 through the outlet 76*b* and may be guided to the discharge port 78.

As the motor 74 is accommodated in the chamber 76, an internal temperature of the chamber 76 may generally increase up to about 80° C. Accordingly, while the air is passing through the chamber 76, the temperature of the air may increase according to the temperature of the inside of the chamber 76.

The discharge port 78 may be provided with a plurality of holes 79 to allow the heated air to pass through the discharge port 78 and then be uniformly injected into the dust collection basket 12.

Further, the guide duct 72 may be provided with a HEPA filter 80 to filter the air. The HEPA filter 80 may serve to prevent fine foreign substances including dust in the air separated in the dust separation member 50 from being discharged from the body 10.

Hereinafter, description will be given of a process in which the binder in the illustrated embodiment binds with foreign substances including dust in the dust collection container 12, with reference to FIGS. 5 and 6.

The foreign substances including dust and the binder separated from the air by the dust separation member 50 may be guided to the dust collection container 12. As the binder has a predetermined size and mass, the binder may be separated by the dust separation member 50 and introduced into the dust collection container 12 along with the foreign substances including dust.

The air separated by the dust separation member 50 may be moved to the guide duct 72. The guide duct 72 may be connected to the inlet 76*a* to allow the air to move to the chamber 76. The motor 74 may be provided in the chamber 76. As the motor 74 remains at about 100° C. while being driven, the air may be heated in the chamber 76.

The air in the chamber 76 may be discharged through the outlet 76*b*, and then guided to the discharge port 78 by the guide duct 72. The heated air injected from the side discharge port 78*a* may heat a lower surface of the dust collection container 12, and the air injected from the side discharge port 78*b* may heat a side surface of the dust collection container 12. Accordingly, an overall temperature of the dust collection container 12 may increase, and thus, the binder collected in the dust collection container 12 may melt, clumping foreign substances including dust.

As the solid binder melts into a liquid for a predetermined period of time, a plurality of dust particles may bind with a plurality of binder particles. Thereby, a mass of foreign substances, including dust, in the dust collection container 12 may increase, and accumulation and density of the foreign substances, including the dust, may increase. Accordingly, more foreign substances may be accumulated in the dust collection container 12, and scattering of dust may be prevented when the dust collection container 12 is emptied.

Figure 7:
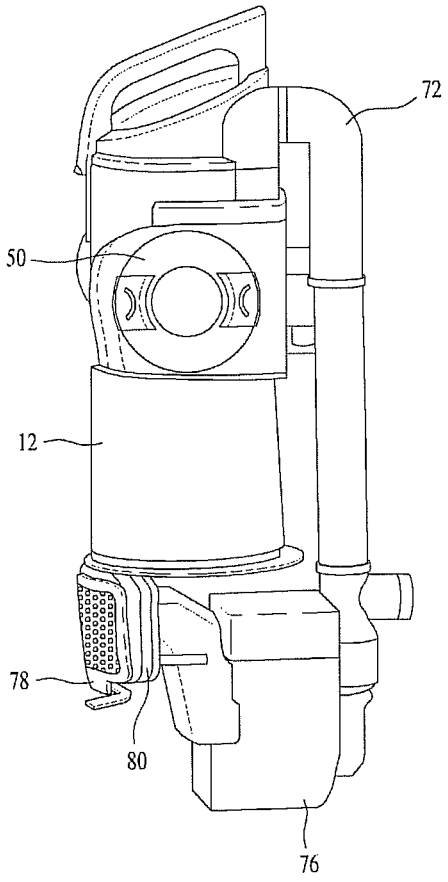
FIG. 7 is a schematic view of a vacuum cleaner according to another embodiment.
Figure 8:
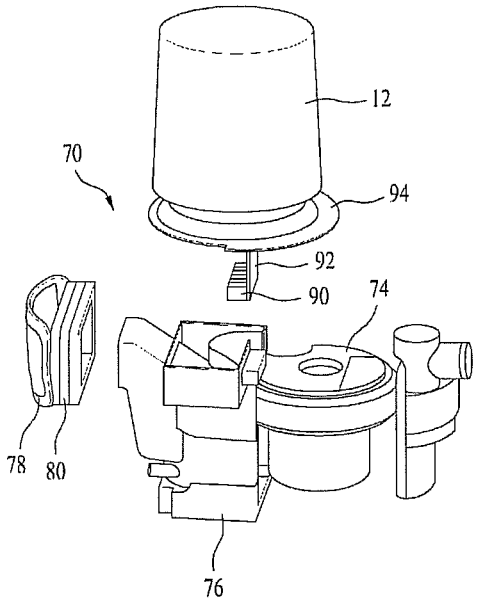
FIG. 8 is an exploded view of components of the vacuum cleaner of FIG. 7.
Figure 9:
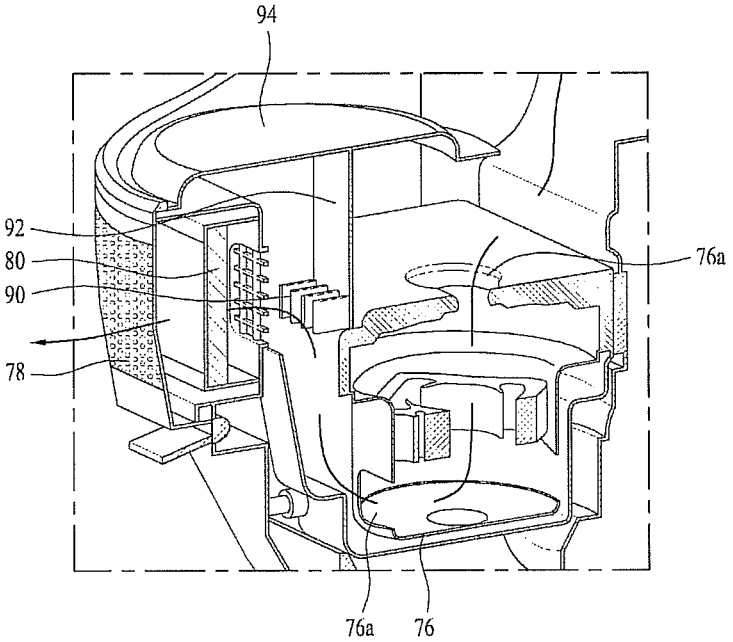
FIG. 9 is a cross-sectional view of the vacuum cleaner of FIG. 7.

FIG. 7 is a schematic view of a vacuum cleaner according to another embodiment. FIG. 8 is an exploded perspective view of components of the vacuum cleaner of FIG. 7. FIG. 9 is a cross-sectional view of the vacuum cleaner of FIG. 7. Hereinafter, description will be given with reference to FIGS. 7-9.

In this embodiment, heat from the motor 74 may be used to heat the dust collection container 12, as in the previous embodiment. However, in this embodiment, the air heated by the guide duct 72 may not be directly injected into the dust collection container 12, but rather, the air may undergo an additional heat exchange process, and then, the dust collection container 12 may be heated by heat produced in this additional heat exchange process. Compared to the previous embodiment, the air injected to the outside of the guide duct 72 according to this embodiment may affect air flow less, and therefore an increase in load applied to the motor 74 may be prevented.

With this embodiment, the heat supply device 70 may include motor 74 to generate flow in the dust separation member 50, guide duct 72 to guide air separated by the dust separation member 50 such that the air exchanges heat with the motor 74, and discharge port 78 to guide the air such that the air may be discharged from the guide duct 72 to the open outside.

The discharge port 78 may not direct the air toward the dust collection container 12, but rather, may guide the air such that the air is discharged to the outside. Therefore, a number of factors that interfere with flow of air discharged from the discharge port 78 may be reduced, and thus, overload of the motor 74 may be prevented.

The heat supply device 70 may further include a chamber 76 to accommodate the motor 74. The chamber 76 may be provided with inlet 76*a* that allows the air to be introduced from the guide duct 72 into the chamber 76 therethrough, and outlet 76*b* that allows the air to be discharged from the chamber 76 to the guide duct 72 therethrough.

A heat exchange member 90 may be provided in the guide duct 72. The air having passed through the guide duct 72 may exchange heat with the heat exchange member 90, such that heat may be supplied from the air to the dust collection container 12.

A heat transfer member 92 may be provided to deliver heat from the heat exchange member 90. The heat transfer member 92 may be connected to a bottom plate 94 arranged adjacent to the dust collection container 12. That is, heat may be transferred from the air to the heat exchange member 90 through a heat exchange process and then moved to the bottom plate 94 via the heat transfer member 92. Thus, an inner side of the dust collection container 12 may be heated by the bottom plate 94.

The heat exchange member 90, the heat transfer member 92, and the bottom plate 94 may be formed of a material, such as aluminum, which has a high heat transfer efficiency.

A HEPA filter 80 may be arranged at a position at which the discharge port 78 is coupled to the guide duct 72 to prevent foreign substances contained in the air discharged from the guide duct 72 from being discharged to the outside.

Hereinafter, operation according to this embodiment will be described.

The foreign substances including dust and the binder separated by the dust separation member 50 may be guided to the dust collection container 12. As the binder has a predetermined size and mass, the binder may be separated by the dust separation member 50 and introduced into the dust collection container 12 along with the foreign substances including dust.

The air separated by the dust separation member 50 may be moved to the guide duct 72. The guide duct 72 may be connected to the inlet 76*a* to allow the air to move to the chamber 76. The motor 74 may be provided in the chamber 76. As the motor 74 remains at about 100° C. while driven, the air may be heated in the chamber 76.

The air in the chamber 76 may be discharged through the outlet 76*b*, and then be guided to the discharge port 78 by the guide duct 72. The heated air may heat the heat exchange member 90 while passing by or through the heat exchange member 90. The heat may be transferred from the heat transfer member 92 to the bottom plate 94. Thereby, the dust collection container 12 may be heated by the bottom plate 94.

Accordingly, an overall temperature of the dust collection container 12 may increase, and thus, the binder collected in the dust collection container 12 may melt, clumping foreign substances including dust. As the solid binder melts into a liquid for a predetermined period of time, a plurality of dust particles may bind with a plurality of binder particles. Thereby, a mass of foreign substances, including dust, in the dust collection container 12 may increase, and accumulation and density of the foreign substances, including dust, may increase. Accordingly, more foreign substances may be accumulated in the dust collection container 12. In addition, when the dust collection container 12 is removed from the body 10 and emptied, scattering of dust may be prevented.

Figure 10:
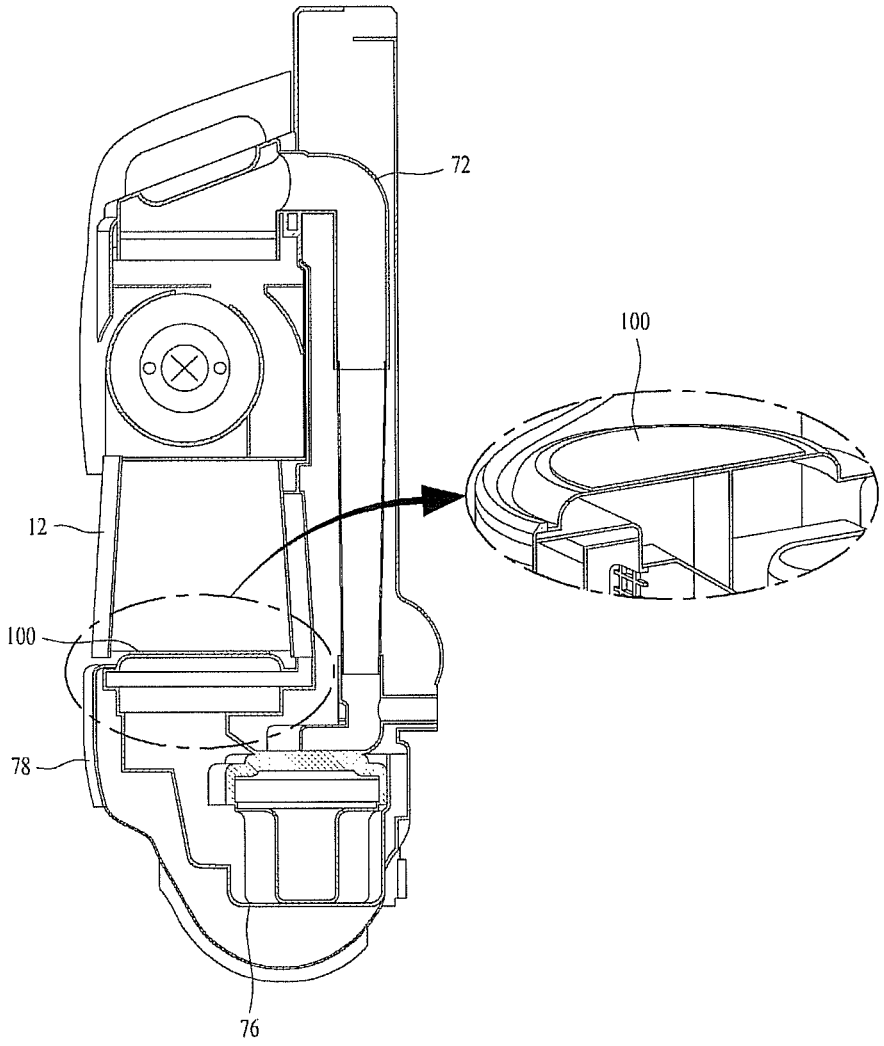
FIG. 10 is a schematic view of a vacuum cleaner according to another embodiment.

FIG. 10 is a schematic view of a vacuum cleaner according to another embodiment. Hereinafter, description will be given with reference to FIG. 10.

In this embodiment, a heater 100 to generate heat using electric power may be adopted as a heat supply device. The heater 100 may be driven by electricity supplied to the motor 74 which drives the vacuum cleaner.

The heater 100 may be arranged adjacent to the dust collection container 12 to heat the dust collection container 12. More particularly, the heater 100 may be arranged adjacent to a bottom surface of the dust collection container 12. As foreign substances including dust and the binder have predetermined masses, they are likelier to be distributed at a lower side of the dust collection container 12 than at an upper side thereof. Accordingly, heating the lower side of the dust collection container 12 may increase efficiency of melting the binder.

The heater 100 may be operated while the motor 74, which generates a rotational flow in the dust separation member 50, is driven. A time during which the motor 74 is driven may be a time during which foreign substances including dust are suctioned in by the suction nozzle 30, and may be substantially similar to a time during which cleaning is performed. In addition, as air flow is produced through the guide pipe 40, this time may be similar to a time during which the binder is allowed to move from the binder case 62 to the guide pipe 40 by a velocity of flow through the guide pipe 40. Accordingly, an operation time of the heater 100 may be controlled to be similar to a driving time of the motor 74.

When electricity is applied to the heater 100, heat may be generated by the heater 100. As the heater 100 is arranged adjacent to the dust collection container 12, an inner side of the dust collection container 12 may be heated by heat from the heater 100. Therefore, as the binder melts, the foreign substances including dust may clump.

The position of the heater 100 may be changed as desired by the designer of the vacuum cleaner.

Figure 11:
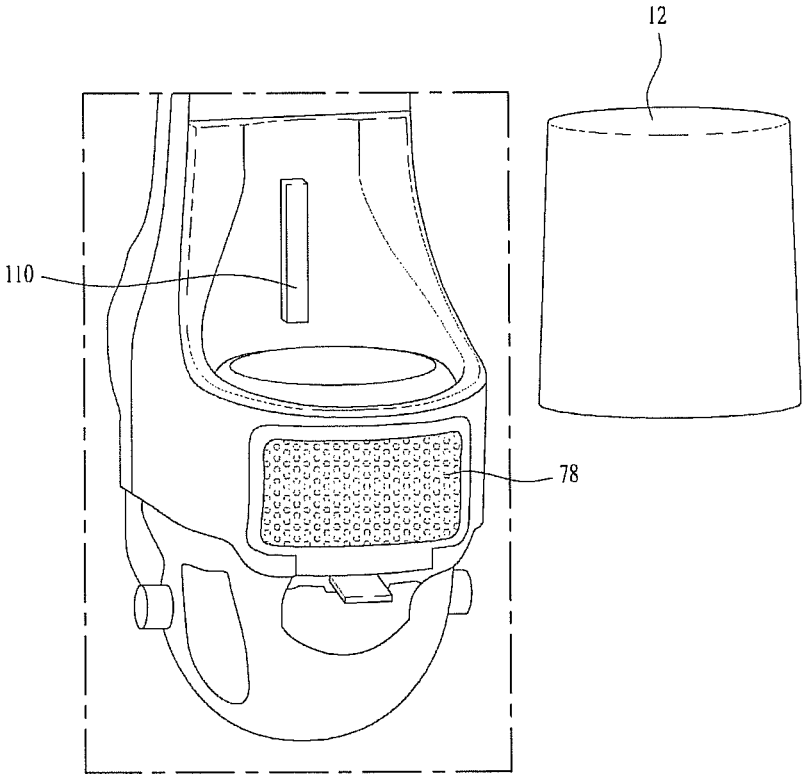
FIG. 11 is a schematic view of a vacuum cleaner according to another embodiment.

FIG. 11 is a schematic view of a vacuum cleaner according to another embodiment. Hereinafter, description will be given with reference to FIG. 11.

In this embodiment, an infrared lamp 110 to irradiate the dust collection container 12 with infrared light may be adopted as a heat supply device. A temperature of an inside of the dust collection container 12 may be increased by the infrared light emitted by the infrared lamp 110. Accordingly, the binder in the dust collection container 12 may melt, and the binder may bind with foreign substances including dust. Thereby, this embodiment may obtain the same effect as that of the previous embodiments.

Further, when the dust collection container 12 is irradiated with infrared light, the inside of the dust collection container 12 may be prevented from becoming damp and may be sterilized. To achieve the above effects with infrared light, the dust collection container 12 needs to be irradiated with the infrared light for a predetermined period of time. The time for which the vacuum cleaner is used by the user may be generally equal to or longer than the predetermined period of time.

The infrared lamp 110 may be arranged at a back of the dust collection container 12. As an overall shape of the dust collection container 12 may be similar to a cylinder, infrared light may be spread throughout the inside of the dust collection container 12 even when emitted only onto one side of the dust collection container 12.

The dust collection container 12 may be formed of a transparent material. This is intended to allow the infrared light emitted from the infrared lamp 110 to be smoothly transmitted to the inside of the dust collection container 12.

Unlike the embodiment shown in FIG. 11, the infrared lamp 110 may be arranged along a surface of the body 10 contacting an inner surface of the dust collection container 12 to surround the dust collection container 12. In this case, the dust collection container 12 may be irradiated with a large portion of the infrared light, and thus, the effect of the infrared light may be enhanced.

The infrared lamp 110 may be operated while the motor 74, which generates a rotational flow in the dust separation member 50, is driven. A time for which the motor 74 is driven may be a time during which foreign substances including dust are suctioned in by the suction nozzle 30, and may be substantially similar to a time for which cleaning is performed. In addition, as air flow is produced through the guide pipe 40, this time may be similar to a time during which the binder is caused to move from the binder case 62 to the guide pipe 40 by a velocity of flow through the guide pipe 40. Accordingly, an operation time of the infrared lamp 110 may be controlled to be similar to a driving time of the motor 74.

Figure 12:
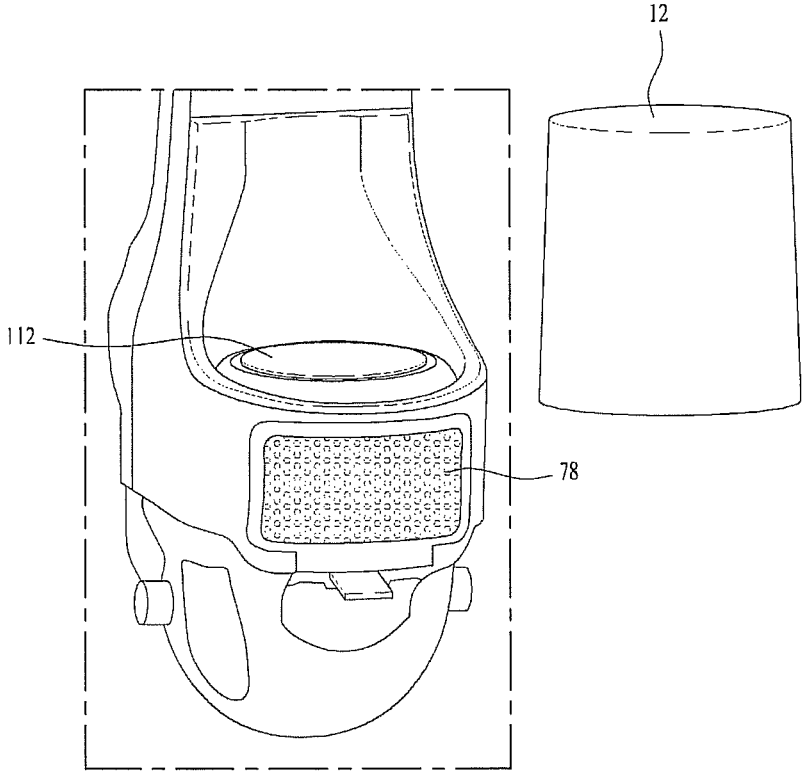
FIG. 12 is a schematic view showing a variation of the vacuum cleaner of FIG. 11.

FIG. 12 is a schematic view showing a variation of the vacuum cleaner of FIG. 11. Hereinafter, description will be given with reference to FIG. 12.

In the embodiment shown in FIG. 12, the infrared lamp 112 may be disposed on a bottom surface of the dust collection container 12, rather than on the side surface of the dust collection container 12. Accordingly, the infrared light emitted from the infrared lamp 112 may relatively strongly heat the bottom of the dust collection container 12.

As the infrared lamp 112 is disposed on the bottom surface of the dust collection container 12, the bottom surface of the dust collection container 12 may be formed of a transparent material. Herein, unlike the bottom surface of the dust collection container 12, the side surface of the dust collection container 12 may be formed of a material that is not transparent as the infrared light is emitted onto the inside of the dust collection container 12 through the bottom surface the dust collection container 12.

As is apparent from the above description, embodiments disclosed herein may have at least the following advantages.

According to embodiments disclosed herein, a larger amount of dust may be accumulated in a dust collection basket or container, and therefore the dust collection basket may be effectively used. Further, according to embodiments disclosed herein, dust particles may be agglomerated together and collected in the duct collection basket. Therefore, the dust particles may be prevented from dirtying surroundings when the dust collection basket is emptied. Furthermore, according to embodiments disclosed herein, dust particles may accumulate to a relatively high concentration, and therefore, a portion in the dust collection basket where the dust is accumulated may be clearly distinguished from another portion where the dust is not accumulated. Therefore, a user may easily gauge an amount of accumulated dust in the dust collection basket and a time to empty the dust collection basket.

Embodiments disclosed herein are directed to a vacuum cleaner that substantially obviates one or more problems due to limitations and disadvantages of the related art.

Embodiments disclosed herein provide a vacuum cleaner capable of accumulating a larger amount of dust in a dust collection basket.

Embodiments disclosed herein provide a vacuum cleaner capable of preventing surroundings from being dirtied by dust when a dust collection basket filled with the dust is emptied.

Embodiments disclosed herein provide a vacuum cleaner that may include a suction nozzle provided at or on a body to suction in dust, a guide pipe to guide the dust suctioned through the suction nozzle, a dust separation member to separate the dust guided along the guide pipe from air, a dust collection basket or container to accommodate the dust separated in the dust separation member, a heat supply unit or device to supply heat to the dust collection basket, and a binder supply unit or device to supply a binder. The binder may be melted by heat supplied from the heat supply unit to bind with the dust. The binder may be supplied prior to introduction of the dust into the dust separation member and may be mixed with the dust in the dust separation member.

The binder supply unit may be connected to the guide pipe to supply the binder to the guide pipe. The binder supply unit may include a binder case to accommodate the binder, and a communication pipe that allows the binder case to communicate with the guide pipe. The heat supply unit may supply heat to a lower portion of the dust collection basket. The heat supply unit may include a motor to generate air flow in the dust separation member, a guide duct to guide the air separated in the dust separation member such that the air exchanges heat with the motor, and a discharge port to guide the air such that the air is discharged from the guide duct toward the dust collection basket.

The body may be provided with a chamber to accommodate the motor. The guide duct may penetrate the chamber. The discharge port may include a side discharge port arranged on a side surface of the dust collection basket and a lower surface discharge port arranged on a lower surface of the dust collection basket. The guide duct may be provided with a HEPA filter to filter the air.

The heat supply unit may include a heat exchange member to transfer heat to the dust collection basket by thermal conduction. The heat supply unit may further include a motor to generate flow in the dust separation member, a guide duct to guide the air separated in the dust separation member such that the air exchanges heat with the motor, and an discharge port to guide the air such that the air is discharged from the guide duct to an open outside. The heat exchange member may be arranged in the guide duct, and air passing through the guide duct may exchange heat with the heat exchange member such that heat in the air is supplied to the dust collection basket.

The vacuum cleaner may further include a bottom plate arranged adjacent to a bottom surface of the dust collection basket to receive heat from the heat exchange member. The heat supply unit may include a heater arranged adjacent to the bottom surface of the dust collection basket. The heat supply unit may include an infrared lamp to irradiate the dust collection basket with infrared light, and the dust collection basket may be formed of a transparent material.

Embodiments disclosed herein provide a vacuum cleaner that may include a suction nozzle provided at or on a body to suction in dust, a dust separation member to separate the dust supplied from the suction nozzle from air, a dust collection basket or container to accommodate the dust separated in the dust separation member, a binder supply unit or device to supply a binder to the dust separation member, the binder being in a shape of solid granules, and a heat supply unit or device to supply heat to the dust collection basket. The binder may be melted by the heat supplied from the heat supply unit to bind with the dust. The heat supply unit may supply heat to a lower portion of the dust collection basket. The heat supply unit may include a heater, which may be operated while a motor to generate a rotational flow in the dust separation member is driven. The binder may be supplied prior to introduction of the dust into the dust separation member and may be mixed with the dust in the dust separation member. The heat supply unit may include an infrared lamp. The infrared lamp may be operated while a motor to generate a rotational flow in the dust separation member is driven.

Embodiments disclosed herein provide a vacuum cleaner that may include a suction nozzle provided at a body to suction in dust, a dust separation member to separate the dust supplied from the suction nozzle from air according to a principle of a cyclonic separation, a dust collection basket or container to accommodate the dust separated in the dust separation member, a binder supply unit or device to supply a binder to the dust separation member, the binder being in a shape of solid granules, and a heat supply unit or device to supply heat to the dust collection basket. The binder may melt in the dust collection basket and bind with the dust to form a particle larger than a particle of the dust.

It will be apparent to those skilled in the art that various modifications and variations can be made without departing from the spirit or scope. Thus, it is intended that embodiments cover modifications and variations provided they come within the scope of the appended claims and their equivalents.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vacuum cleaner, comprising:

a body;

a suction nozzle provided at or on the body to suction in foreign substances including dust;

a guide pipe to guide the foreign substances including the dust suctioned in through the suction nozzle;

a separation member to separate the foreign substances including the dust guided along the guide pipe from air;

a collection container to accommodate the foreign substances including the dust separated in the separation member;

a heat supply device to supply heat to the collection container; and a binder supply device that supplies a binder to the guide pipe, wherein the binder is melted by the heat supplied from the heat supply device to bind with the foreign substances including the dust, and wherein the heat supply device includes:

a motor accommodated in a chamber in a chamber in the body to generate a suction force and a flow in the separation member;

a guide duct connected to the separation member, wherein the guide duct penetrates the chamber and guides the air separated in the separation member such that the air exchanges heat with the motor; and a discharge port arranged adjacent to the collection container to guide air heated by the motor such that the air is discharged from the guide duct toward an outer surface of the collection container, wherein the discharge port includes a first discharge port arranged adjacent a side surface of the collection container, the first discharge port including a duct formed between an inner surface of the collection chamber and an outer surface of the collection chamber and a plurality of elongated holes that allows the air heated by the motor to flow into the collection chamber at the side surface of the collection container, and a second discharge port arranged adjacent a lower surface of the collection container, the second discharge port including a plurality of holes formed in the lower surface of the collection chamber that allows the air heated by the motor to flow into the collection chamber at the lower surface of the collection container.

2. The vacuum cleaner according to claim 1, wherein the binder supply device supplies the binder before the foreign substances including the dust are introduced into the separation member, and wherein the binder is mixed with the foreign substances including the dust in the separation member.

3. The vacuum cleaner according to claim 1, wherein the binder supply device is connected to the guide pipe to supply the binder to the guide pipe.

4. The vacuum cleaner according to claim 3, wherein the binder supply device includes:

a binder case to accommodate the binder; and a communication pipe that allows the binder case to communicate with the guide pipe.

5. The vacuum cleaner according to claim 4, further including:

a valve provided to open and close the communication pipe.

6. The vacuum cleaner according to claim 4, wherein the communication pipe is connected to the guide pipe at a connection point.

7. The vacuum cleaner according to claim 6, wherein the guide pipe narrows at the connection point.

8. The vacuum cleaner according to claim 1, wherein the heat supply device supplies the heat to at least a lower portion or a side portion of the collection container.

9. The vacuum cleaner according to claim 1, wherein the guide duct includes a HEPA filter to filter the air.

10. A vacuum cleaner, comprising:

a body;

a suction nozzle provided at or on the body to suction in foreign substances including dust;

a separation member to separate the foreign substances including the dust supplied from the suction nozzle from air;

a collection container to accommodate the foreign substances including the dust separated in the separation member;

a binder supply device to supply a binder to the separation member, the binder being in a form of solid granules; and a heat supply device to supply heat to the collection container, wherein the binder is melted by the heat supplied from the heat supply device to bind with the foreign substances including the dust, and wherein the heat supply device includes:

a motor accommodated in a c chamber in the body to generate a suction force and a flow in the separation member;

a guide duct connected to the separation member, wherein the guide duct penetrates the chamber and guides the air separated in the separation member such that the air exchanges heat with the motor; and a discharge port arranged adjacent to the collection container to guide air heated by the motor such that the air is discharged from the guide duct toward an outer surface of the collection container, wherein the discharge port includes a first discharge port arranged adjacent a side surface of the collection container, the first discharge port including a duct formed between an inner surface of the collection chamber and an outer surface of the collection chamber and a plurality of elongated holes that allows the air heated by the motor to flow into the collection chamber at the side surface of the collection container, and a second discharge port arranged adjacent a lower surface of the collection container, the second discharge port including a plurality of holes formed in the lower surface of the collection chamber that allows the air heated by the motor to flow into the collection chamber at the lower surface of the collection container.

11. The vacuum cleaner according to claim 10, wherein the binder supply device supplies the binder before the foreign substances including the dust are introduced into the separation member, and wherein the binder is mixed with the foreign substances including the dust in the separation member.

12. A vacuum cleaner, comprising:

a body;

a suction nozzle provided at or on the body to suction in foreign substances including dust;

a separation member to separate the foreign substances including the dust supplied from the suction nozzle from air according to a principle of cyclonic separation;

a collection container to accommodate the foreign substances including the dust separated in the separation member;

a binder supply device to supply a binder to the separation member, the binder being in a form of solid granules; and a heat supply device to supply heat to the collection container, wherein the binder melts in the collection container and binds with the foreign substances including the dust to form a particle larger than a particle of the dust, wherein the heat supply device includes:

a motor accommodated in a chamber in the body to generate a suction force and a flow in the separation member;

a guide duct connected to the separation member, wherein the guide duct penetrates the chamber and guides the air separated in the separation member such that the air exchanges heat with the motor; and a discharge port arranged adjacent to the collection container to guide air heated by the motor such that the air is discharged from the guide duct toward an outer surface of the collection container, wherein the discharge port includes a first discharge port arranged adjacent a side surface of the collection container, the first discharge port including a duct formed between an inner surface of the collection chamber and an outer surface of the collection chamber and a plurality of elongated holes that allows the air heated by the motor to flow into the collection chamber at the side surface of the collection container, and a second discharge port arranged adjacent a lower surface of the collection container, the second discharge port including a plurality of holes formed in the lower surface of the collection chamber that allows the air heated by the motor to flow into the collection chamber at the lower surface of the collection container.

* * * * *